United States Patent [19]

Wieland

[11] 4,203,524

[45] May 20, 1980

[54] CHILD-PROOF CLOSURE DEVICE

[76] Inventor: Clarence W. Wieland, 1531 Hyde St. #8, San Francisco, Calif. 94109

[21] Appl. No.: 32,210

[22] Filed: Apr. 23, 1979

[51] Int. Cl.[2] ..... B65D 55/02; B65D 85/56; A61D 1/00

[52] U.S. Cl. ..... 215/216; 215/218; 215/225; 215/306; 220/375; 206/1.5

[58] Field of Search ..... 215/216, 218, 221, 224, 215/225, 306; 206/1.5; 220/375

[56] References Cited

U.S. PATENT DOCUMENTS

| | | | |
|---|---|---|---|
| 3,510,021 | 5/1970 | Silver | 215/216 |
| 3,830,392 | 8/1974 | Kessler et al. | 215/216 |

*Primary Examiner*—George T. Hall

*Attorney, Agent, or Firm*—Townsend and Townsend

[57] ABSTRACT

The disclosed invention is a child-proof closure device for a bottle. The device includes a bottle cap which can be placed in sealing disposition with a cap-receiving upper lip on the bottle, and which is removable from the lip of the bottle with rotation and/or upward excursion on and relative to the upper lip of the bottle. The device includes in combination with this cap, a bottom member for fitting over the bottle bottom in releasable snap engagement therewith, and a strap attached between the bottom member and the cap, the bottom member and strap being configured so that the cap cannot be removed from the bottle without first removing the bottom member from the bottle bottom.

In certain embodiments of the invention, the length of strap between the cap and bottom member is short enough to restrain upward excursion of the cap and prevent its removal when the bottom member is in place on the bottle bottom. In some embodiments of the invention, the bottom member and bottle bottom are configured to contain means for preventing rotation of the bottom member relative to the bottle bottom so as to prevent rotation and removal of the cap on the lip of the bottle.

16 Claims, 5 Drawing Figures

CHILD-PROOF CLOSURE DEVICE

BACKGROUND OF THE INVENTION

1. Field of the Invention

This invention relates to child-proof safety caps or closure devices for medicine bottles.

2. Summary of the Prior Art

The design of child-proof safety caps for medicine and pill bottles is a difficult matter. The problem is that many caps which are difficult for a child to open prove to be equally difficult for an adult to open. Furthermore, even many otherwise effective safety caps present difficulties for arthritic or infirm older adults, who may have visual or manipulative problems. For example, certain caps currently in use can be removed only with simultaneous downward pressure and rotation. Such simultaneous action is difficult for the arthritic adult with limited and painful finger movement. It may easily be possible for such a person to oppose two fingers to grasp the cap for rotation; however, grasping the cap and exerting simultaneous downward pressure is very difficult.

Other caps currently in use, such as the one disclosed in U.S. Pat. No. 3,812,989, although simpler and easier for an infirm adult to use, still present some difficulties for an older, arthritic adult. These caps can be removed only by rotating the cap to a position where a lug positioned on the interior of the cap is in registry with a gap in a locking rib on the bottle neck so that the cap can be removed by snapping it off upwardly. Properly rotating the cap for removal requires close visual or tactile alignment of a portion of the cap with a portion of the bottle neck; this tends to be difficult for older adults with poor eyesight or poor manipulative abilities. Occasionally, too, removal of the cap requires a fair amount of pressure exerted on a small area of the cap which may be manageable only with difficulty by an infirm adult.

It is known and disclosed in U.S. Pat. Nos. 1,924,242 and 1,650,517 to use a closure device which includes a retaining ring surrounding a container in conjunction with a screw-type cap and at least one band attached between the cap and the ring. However, such devices are not intended to be child-proof; the cap is easily removed from the container and the retaining ring and strap merely hold the removed cap adjacent to the container to prevent loss of the cap.

Summary of the invention

The present invention is a child-proof closure device for a bottle which is easily openable by even an arthritic adult. The closure device includes a bottle cap which can be placed in sealing disposition with a cap-receiving upper lip or top of a bottle. The cap is designed to be removable from the lip of the bottle with rotation and/or upward excursion on and relative to the lip. The closure device includes in combination with this cap a bottom member for fitting over the bottle bottom in releasable snap engagement therewith, and a strap attached between the bottom member and the cap. The bottom member and strap are designed so that the cap cannot be removed from the bottle top without first removing the bottom member from the bottle bottom.

The length of strap between the cap and the bottom member is long enough to permit the bottom member to be snapped onto the bottle bottom when the cap is fully seated. In certain embodiments of the invention, this strap length is also short enough to restrain upward excursion of the cap to prevent its removal when the bottom member is in place on the bottle bottom. In these embodiments, the bottom member and/or bottle bottom are configured to contain means for restraining upward movement of the bottom member on the bottle bottom. In some embodiments of the invention, the bottom member and bottle bottom are configured to contain means for preventing rotation of the bottom member relative to the bottle bottom so as to prevent rotation of the cap on the lip of the bottle, and consequently its removal unless the bottom member is first released from engagement with the bottle bottom.

This invention is of particular advantage as a safety cap for a medicine bottle. It is difficult for a child to open a bottle using the device of the present invention because a sequence of orderly movements is required; the bottom member must first be removed, and only then can the cap be removed by rotation and/or upward excursion on the bottle neck. At the same time, it is easily openable by even an arthritic or infirm older adult. It does not requre two difficult simultaneous hand movements. Nor does it require close visual or tactile positioning of the cap before removal. What it does require is a sequence of manipulations which can be accomplished even by those with poor vision or hard-to-move fingers. All in all, it provides a closure device particularly effective for use as a child-proof safety cap for a medicine bottle.

BRIEF DESCRIPTION OF THE DRAWINGS

FIG. 2A illustrates the cap in sealing engagement with the bottle and the bottom member snapped onto the bottle bottom. FIG. 2B illustrates the bottom member being removed from the bottle bottom so that the cap can then be removed. FIG. 2C illustrates rotation of the cap away from a sealing disposition on the bottle neck with resultant upward excursion of the cap on the upper lip of the bottle. FIG. 2D illustrates the entire device removed from the bottle, thereby allowing access to the contents of the bottle, and shows in detail the cap and upper lip of the bottle.

DESCRIPTION OF THE SPECIFIC EMBODIMENTS

Figure 1:
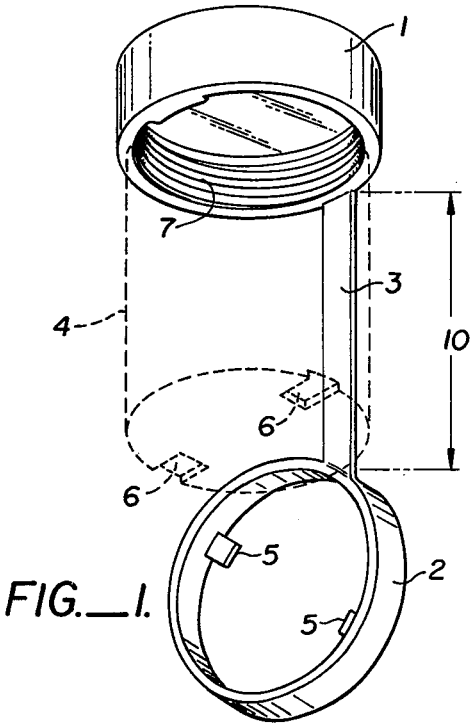
FIG. 1 is a perspective view of the preferred embodiment of the closure device of the present invention with the bottom member removed from the bottle bottom but the cap remaining attached to the bottle.

Referring now to FIG. 1, the preferred embodiment of the closure device of the present invention can be seen. The device consists of a cap 1 in combination with a bottom member 2, and a strap 3 attached therebetween. It is preferably made of a fairly stiff plastic material but other materials can of course be used. The cap 1 is shown in FIG. 1 in sealing engagement with the upper lip or top 9 of a bottle 4, the upper lip 9 of the bottle being more visible in FIG. 2D. The cap 1 is designed so that it can be removed from the bottle only with rotation and/or upward excursion on the bottle top away from sealing engagement with the bottle top. In the preferred embodiment, the interior of the cap 1 contains female threads 7 complementary to male threads 8 on the cap-receiving upper lip 9 of the bottle 4 as shown in both FIGS. 1 and 2D, so that it can be removed only with rotation on the threads of the upper lip and accompanying upward excursion on the lip. The length 10 of the portion of strap 3 between the cap and bottom member is long enough to permit the bottom member 2 to be snapped onto the bottle bottom when the cap 1 is in sealing engagement with the bottle top, but in the preferred embodiment is short enough to prevent upward excursion of the cap when the bottom member is in place on the bottle bottom.

The bottom member 2 is preferably in the form of a band which fits around and confronts the bottle bottom. Furthermore, the bottom member and/or the bottle is preferably configured so as to include means for restraining upward movement of the bottom member on the bottle bottom. Such means preferably are in the form of keys or tabs 5 which extend under the bottle bottom when the bottom member is snapped in place. The keys 5 preferably fit into keyways 6 on the bottle bottom so that the bottom surface of the bottle plus closure device is flush and so that rotation of the bottom member on the bottle and thereby the cap on the upper lip is prevented. Naturally, where the bottle bottom is not circular, the configuration of the band itself will prevent such rotation of the bottom member.

Figure 2A:
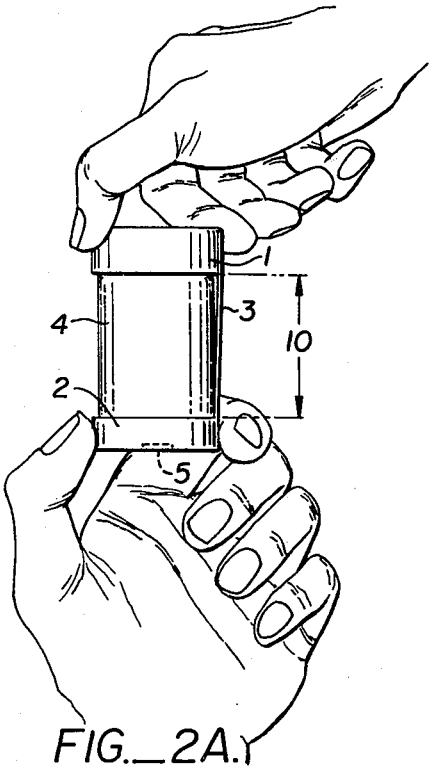
FIGS. 2A through 2D are side elevations of the preferred embodiment of the closure device of the present invention in use.

FIGS. 2A through 2D illustrate in series the use of the preferred embodiment of the closure device of the present invention. FIG. 2A illustrates the closure device in place on the bottle. The cap 1 is in sealing engagement with upper lip 9 of the bottle 4, and the bottom member 2 is snapped onto the bottle bottom. As shown in FIG. 2A, the length 10 of strap 3 between cap 1 and bottom member 2 is short enough relative to the height of the bottle to prevent upward excursion of the cap and thereby removal of the cap while the bottom member 2 is in place on the bottle bottom.

Figure 2B:
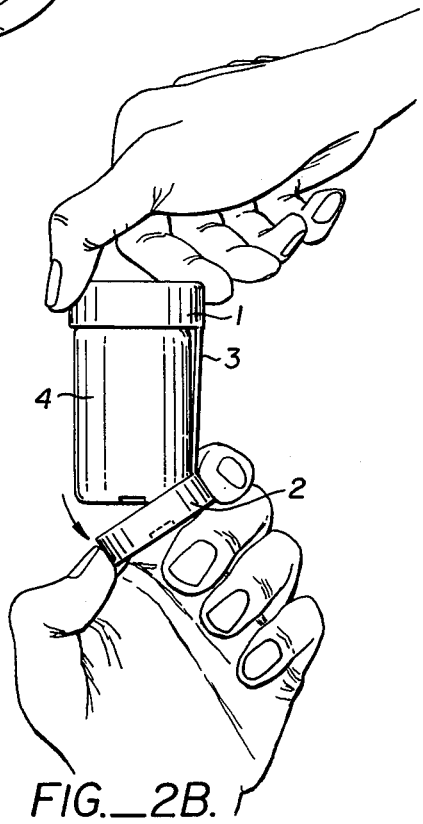
Figure 2C:
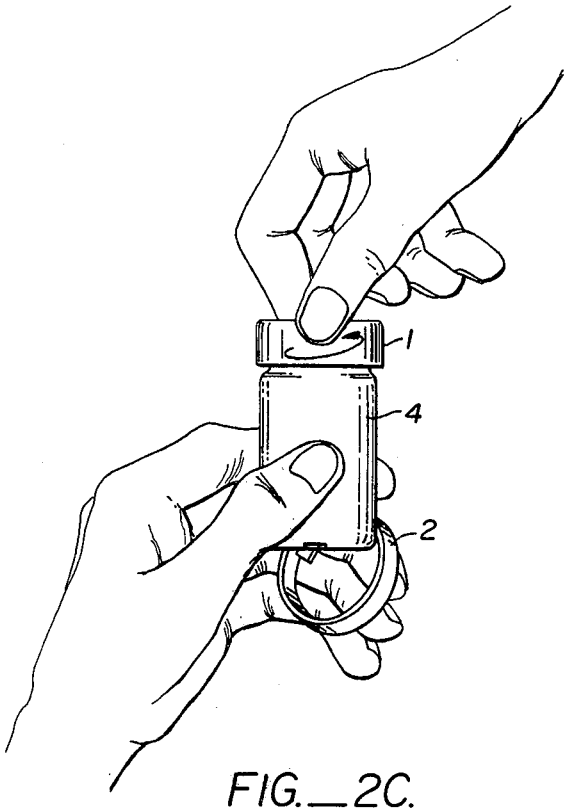
Figure 2D:
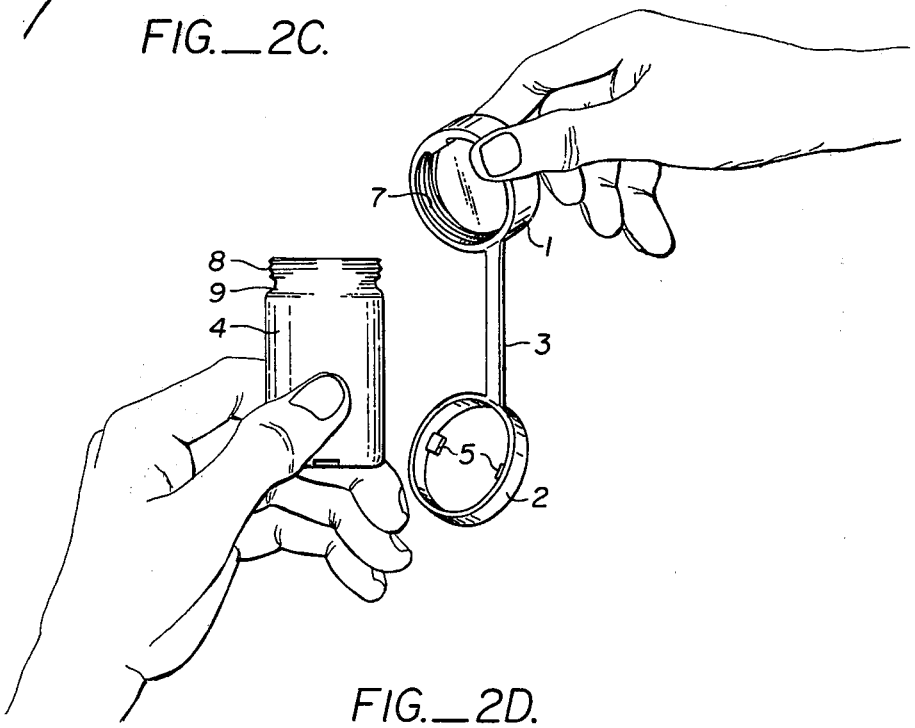

In FIG. 2B, the bottom member 2 is being snapped off the bottle bottom; once the bottom member is removed, the cap 1 is freed for removal from the bottle. In FIG. 2C, the cap 1 is being removed from the bottle; this is accomplished by rotating the cap 1 on complementary threads 8 of the bottle neck 9 in the direction shown by the arrow. This rotation is accompanied by upward excursion of the cap 1 on the bottle top which is possible once the bottom member is removed from the bottle bottom. In FIG. 2D, the closure device has been entirely removed from the bottle and the contents of the bottle are then accessible. For subsequent replacement of the closure device on the bottle, the above sequence of movements is reversed; the user places the cap on the upper lip of the bottle and rotates it into sealing engagement therewith. The bottom member is then snapped into place on the bottle bottom.

Thus, it can be seen that the closure device of the present invention is particularly effective as a safety cap for a medicine bottle; the sequence of movements prevents easy removal by a child. However, even an arthritic, infirm older adult is capable of removing the device it from the bottle for access to the contents of the bottle. A certain amount of pressure on the bottom member is all that is necessary for removal of the bottom member from the bottle bottom. Furthermore, the slight pressure on the bottle cap as well as opposition of two fingers necessary for cap removal can be accomplished even by those with arthritic difficulties.

Naturally, the above description and the drawings are intended by way of illustration, and many variations can be made in the scope of the invention which is described by the appended claims.

What is claimed is:

1. An improved closure for a bottle with a bottle cap, said bottle including a bottle bottom and a cap receiving upper lip for mating engagement with said bottle cap, said cap designed to undergo vertical movement towards and away from a sealing disposition on said cap-receiving upper lip, the improvement in said cap comprising: a bottom member for fitting over the bottom of said bottle in releasable snap engagement therewith and configured with respect to said bottle to include means for restraining upward movement of said bottom member relative to said bottle when said bottom member is in place on said bottle bottom; a strap extending between and attached to said bottom member at one portion and said bottle cap at another portion, said strap having a length between said portions long enough to permit said bottom member to be snapped over the bottom of said bottle when said cap is fully seated on said cap-receiving upper lip of said bottle, and short enough to restrain upward excursion of said cap when said bottom member is in place over the bottom of said bottle whereby said cap cannot be removed from said bottle without first removing said bottom member from said bottle bottom.

2. The invention of claim 1 and wherein said cap-receiving upper lip of said bottle has threads thereon for mating engagement with said bottle cap and said bottle cap has complementary threads, said cap when rotated on said threads on said upper lip undergoing said vertical movement.

3. The invention of claim 2 and wherein the cap-receiving upper lip of said bottle has male threads and the cap has female threads.

4. The invention of claim 1 and wherein the bottom member and cap are fastened to opposite remote ends of said strap.

5. The invention of claim 1 and wherein the bottom member is configured with respect to the bottle bottom to prevent rotation of the bottom member relative to the bottle bottom when the bottom member is engaged with the bottle bottom.

6. The invention of claim 5 and wherein the snap engagement of said bottom member with said bottle includes means for defining mutually interlocking key and keyway to restrain relative rotation between said bottle bottom and said bottom member.

7. The invention of claim 6 wherein said means for defining mutually interlocking key and keyway includes a key on said bottom member.

8. The invention of claim 1 and wherein said bottom member includes a band which encircles and confronts said bottle bottom when said bottom member is engaged with said bottle bottom.

9. The invention of claim 8 and wherein said means for restraining upward movement of said bottom member includes a key on said band which extends under the bottle bottom when said bottom member is engaged with said bottle bottom.

10. In the combination of a bottle having a bottom and an upper open end with a round top, said top including threads, and an upper cap having threads complementary to the threads included on said bottle top, whereby said cap is brought into firm sealing engagement with the top of said bottle by rotation of said cap on and with respect to said top, an improved cap for said bottle comprising in combination:

said upper cap;

a band for fitting around and confronting the bottom of said bottle, said band being configured with respect to the bottom of said bottle to prevent rotation of said band relative to said bottle bottom upon engagement with the bottom of said bottle;

a restraining strap extending between and attached to a portion of said upper cap and said band, the portion of said restraining strap between said cap and said band being of a length relative to the height of the bottle to permit said band to snap over the bottom of said bottle when said upper cap is fully engaged on said top of said bottle whereby when said band is fitted around the bottom of the bottle, relative rotation of said band and thereby said cap with respect to said bottle cannot occur to open said bottle.

11. The invention of claim 10 and wherein said band and said bottle bottom include means for defining mutually interlocking key and keyway to restrain relative rotation between said band and said bottle bottom.

12. The invention of claim 11 and wherein said means for defining mutually interlocking key and keyway includes a key on said band.

13. The invention of claim 10 and wherein the band and upper cap are fastened to opposite remote ends of said strap.

14. The invention of claim 10 and wherein said top of the bottle has male threads and said upper cap has female threads.

15. The invention of claim 10 and wherein said cap is brought into and away from firm sealing engagement with the top of said bottle only by undergoing vertical excursion with respect to said bottle top upon rotation of said cap; said band is configured with respect to said bottle bottom to include means for restraining upward movement of said band relative to said bottle when said band is fitted around the bottle bottom; and the portion of said restraining strap between said cap and said band is of a length to prevent upward excursion of said cap relative to said top away from firm sealing engagement therewith when said band is in sealing engagement with the bottle bottom whereby said cap cannot be removed from said bottle without first removing said band from said bottle bottom.

16. The invention of claim 15 and wherein said means for restraining upward movement of said band includes a key on said band which extends under the bottle bottom when said band is fitted around said bottle bottom.

* * * * *